US011788696B2

(12) United States Patent
Imbert et al.

(10) Patent No.: US 11,788,696 B2
(45) Date of Patent: Oct. 17, 2023

(54) ARTIFICIAL FIREPLACE

(71) Applicant: ATELIER DOMINIQUE IMBERT, Viols le Fort (FR)

(72) Inventors: Dominique Imbert, Viols le Fort (FR); Laurent Gaborit, Clapiers (FR); Christophe Ploye, Prades le Lez (FR)

(73) Assignee: ATELIER DOMINIQUE IMBERT, Viols le Fort (FR)

( * ) Notice: Subject to any disclaimer, the term of this patent is extended or adjusted under 35 U.S.C. 154(b) by 8 days.

(21) Appl. No.: 17/761,493

(22) PCT Filed: Sep. 16, 2020

(86) PCT No.: PCT/EP2020/075875
§ 371 (c)(1),
(2) Date: Mar. 17, 2022

(87) PCT Pub. No.: WO2021/053019
PCT Pub. Date: Mar. 25, 2021

(65) Prior Publication Data

US 2022/0364697 A1 Nov. 17, 2022

(30) Foreign Application Priority Data

| | | |
|---|---|---|
| Sep. 17, 2019 | (FR) | 1910226 |
| Nov. 28, 2019 | (FR) | 1913416 |
| Jul. 9, 2020 | (FR) | 20184882.7 |

(51) Int. Cl.
*F21S 10/04* (2006.01)
*F24C 7/00* (2006.01)

(52) U.S. Cl.
CPC ..... *F21S 10/04* (2013.01); *F24C 7/004* (2013.01)

(58) Field of Classification Search
CPC ..... F21S 10/04–046; F24C 7/004
See application file for complete search history.

(56) References Cited

U.S. PATENT DOCUMENTS

2006/0150966 A1 7/2006 Jamieson

FOREIGN PATENT DOCUMENTS

| | | |
|---|---|---|
| CA | 2726061 A1 | 5/2011 |
| CN | 1222226 A | 7/1999 |
| CN | 1808263 A | 7/2006 |

(Continued)

*Primary Examiner* — Mariceli Santiago
(74) *Attorney, Agent, or Firm* — Craft Chu PLLC; Andrew W. Chu

(57) ABSTRACT

The artificial fireplace includes an enclosure delimited by a lower wall, an upper wall and a peripheral wall. The peripheral wall includes an opening, a bed of fake embers being disposed inside the enclosure on a base defined by the lower wall. The enclosure is also provided with a projector for an image, in particular animated flames, towards a display screen disposed in the enclosure in a line of sight extending through the opening. The display screen is defined by a transparent glass plate extending between the bed of fake embers and the projector, while forming, in relation to the incident ray emanating from the projector, an angle ranging between 50° and 56°. The projector is defined for broadcasting images, in particular animated flames, through a linear polarized light. The invention also relates to a fireplace unit or stove comprising an artificial fireplace.

12 Claims, 2 Drawing Sheets

(56) References Cited

FOREIGN PATENT DOCUMENTS

| | | | | | |
|---|---|---|---|---|---|
| CN | 105910060 | A | * | 8/2016 | |
| EP | 2807426 | B1 | | 8/2016 | |
| FR | 3059761 | A1 | | 6/2018 | |
| GB | 2151772 | A | | 7/1985 | |
| WO | 02 077533 | A1 | | 3/2002 | |
| WO | WO-2020145819 | A1 | * | 7/2020 | ..... F21S 10/04 |

* cited by examiner

ARTIFICIAL FIREPLACE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention belongs to the field of fireplace units, and more particularly to the field of decorative fireplace units. More precisely, the invention relates to the field of fireplaces, whether these be fireplace units having an open or closed fireplace, a stove, or even an insert.

In particular, the present invention relates to an artificial fireplace integrated in a fireplace unit, which is preferably decorative in nature.

2. Description of Related Art Including Information Disclosed Under 37 CFR 1.97 and 37 CFR 1.98

In a general manner, a fireplace unit comprises a fireplace that is delimited by an enclosure, inside which it is conventional to light and sustain a fire, the calorific energy of which is diffused by radiation and/or conduction and/or convection, so as to heat premises or a house.

Typically, the fire is produced on the basis of wood or other fuels, such as alcohol or gas. However, there are also fireplaces which accommodate electric heating resistors.

The particularity of a fireplace unit is the opening which it typically comprises in the front part of the peripheral wall thereof, making it possible to render visible the embers and the amination of the flames of wood combustion, which is particularly agreeable from the perspective of a user, contributing to an impression of peace, heat, and well-being.

In order not to deprive users of a stove of such sensations, it is increasingly common to also equip these with a glazed opening at the periphery, offering a line of sight into the inside of the enclosure of the fireplace.

Of course, the constancy and the colder color of flames of a gas burner, or indeed the resistors of an electric fireplace, are not capable of achieving such impressions of well-being and comfort.

In this case, in particular, it is known to install, on the base of the enclosure of the fireplace, a bed of artificial embers often made up of a reproduction of logs housing red/orange lighting of varied intensity, in an attempt to imitate smoldering embers.

Artificial fireplace units also exist which comprise a fireplace defining an enclosure inside which only means for artificial reproduction of a wood fire are located.

The object consists, in this case, in providing the above-mentioned sensations, while setting aside the heating function which is usually produced by a fireplace of this kind.

In order to meet this need, various means for artificially reproducing a wood fire have been developed.

In particular, the document GB 2 151 772 discloses an artificial fireplace unit which comprises a reflection hologram illustrating flames displayed on a vertical or slightly inclined plate. In order to simulate movement, the hologram is illuminated alternately by different lamps arranged at the top and at the bottom of the fireplace. Lights for simulating a bed of incandescent embers can be associated with the fake fuel elements. Consequently, through the opening in the enclosure of the fireplace, the user sees a juxtaposition of elements, i.e. a bed of embers, behind which a holographic image of flames appears.

The document WO 02/077533 also discloses an artificial fireplace unit comprising a semi-reflective plate that is inclined at between 10° and 30° and comprises a hologram displaying a combustion source. A light source illuminates the semi-reflective plate from the front and from the top of the enclosure of the fireplace. A lighting and optical reflection effect makes it possible to animate the flame of the hologram displayed on the semi-reflective plate. Fake fuel elements can also emphasize the realism of the optical illusion, being arranged in front of and behind the semi-reflective plate.

Furthermore, the document EP 2 807 426 discloses an artificial fireplace unit comprising a fireplace formed by an enclosure that is open at the front, while a bed of artificial embers is arranged in the lower part. A video screen broadcasting images of flames is arranged in said enclosure of the fireplace, behind the bed of artificial embers, while a dichroic mirror extends in front of said screen and above the bed of artificial embers, at an angle of inclination of 45°.

In combination, a screen broadcasting a background image of a fireplace is arranged under the upper wall of the enclosure. This image is reflected on the dichroic mirror, merging it, above and in the region of the bed of embers, with the images of flames broadcast by the video screen.

In addition, on another inside wall of the enclosure other elements for making a fireplace unit fire are arranged so as to appear, by reflection, on the dichroic mirror.

While the solutions set out above lead to greater juxtaposition of images, the fireplace unit described in said document EP 2 807 426 causes a holographic image, extending largely above the bed of embers, to appear to the user through the opening in the front part of the enclosure of the fireplace.

However, this result is achieved by combining a plurality of images on a dichroic mirror, which is by definition semi-transparent, so as to reflect only a portion of the visible light, at a limited brightness return. Clarity and comfort of feeling is inevitably lost, in the region of the images perceived by an observer located in front of the fireplace unit.

Within the context of an inventive step, it has been attempted to overcome the disadvantages of the prior art by way of a solution that is simple in design, and thus economic, but even so capable of reproducing a wood fire in a fireplace of a fireplace unit, insert, stove or the like, in a manner giving a very significant impression of realism.

BRIEF SUMMARY OF THE INVENTION

For this purpose, the invention relates to an artificial fireplace comprising:

- an enclosure delimited by a lower wall, an upper wall, and a peripheral wall which comprises an opening,
- a bed of fake embers being arranged inside the enclosure on a base defined by the lower wall,
- a display screen arranged in the enclosure,
- a line of sight extending from the display screen as far as the outside of the fireplace, through the opening, and
- projection means arranged in the enclosure, the projection means being designed to transmit an image, in particular of animated flames, towards the display screen.

According to the invention, the fireplace is characterized in that the projection means are designed to transmit, according to an incident ray, images, in particular of animated flames, through a linear polarized light, the display screen being defined by a transparent glass plate which extends between the bed of fake embers and the projection means, the transparent plate forming an angle of between 50° and 56°, with respect to the incident ray.

The advantages which follow from the present invention consist in a spectacular impression of realism of the wood fire which an observer, located in front of the opening of the enclosure of the fireplace, can see. This result is achieved by implementing technical means of simple design. Said means are capable of providing a perfectly clear holographic image emanating on the one hand from the use of a display screen, and on the other hand from projection means for projecting an image of flames according to a beam of linear polarized light emitted according to an angle corresponding to Brewster's law.

According to a first feature of the invention, the projection means are installed under the upper wall of the enclosure. The projection means are thus concealed with respect to the line of sight of an observer.

According to a second feature of the invention, the display screen is arranged on the one hand in the enclosure, between the projection means and the bed of fake embers, and on the other hand in the extension of the opening according to a specified angle with respect to the base of the enclosure.

According to a third feature of the invention, the transparent glass plate comprises, in the region of the rear face thereof and visible through the opening of the enclosure, an anti-reflective treatment.

According to a fourth feature of the invention, the transparent glass plate is held in the enclosure by means of a support structure in the form of a bracket that rests on said base, defining a screen at the rear of the bed of fake embers.

According to a fifth feature of the invention, the transparent glass plate is designed to be adjusted to the walls of the enclosure. This contributes to masking the presence of a display screen from an observer.

According to a sixth feature of the invention, the artificial fireplace is equipped with sound diffusion and/or odor emissions means.

According to a seventh feature of the invention, the artificial fireplace comprises lighting means designed to diffuse an ambient light in the enclosure. This feature contributes to reinforcing the impression of realism.

According to an eighth feature of the invention, the bed of embers is made up of various elements which imitate a combination of wood being burned, embers, and cinders, in materials that are selected so as to allow light radiation, produced by the lighting means installed under said bed of embers, in the form of LEDs suitable of undergoing a variation in light intensity in order to simulate the animation of real incandescent embers, to show through, in part.

According to a ninth feature of the invention, the artificial fireplace comprises means for controlling and managing the operation:

- Of the projection means;
- And/or of ambient lighting means;
- And/or of sound diffusion and/or odor emissions means;
- And/or of lighting means under the bed of embers;
- And/or of heating means, in particular electrical, with which said fireplace is equipped.

According to a tenth feature of the invention, the artificial fireplace is mounted so as to be rotatable about a vertical axis through suspension means, such as a fake flue or a support base.

Another aspect of the invention relates to a fireplace unit or stove comprising an artificial fireplace according to the invention. Said fireplace unit or stove is characterized in that it comprises a fake flue which integrates heating means, preferably of the dry inertia electric type.

BRIEF DESCRIPTION OF THE SEVERAL VIEWS OF THE DRAWINGS

Other aims and advantages of the present invention will emerge from the following description, relating to an embodiment given by way of non-limiting example.

This description will be better understood with reference to the accompanying drawings.

DETAILED DESCRIPTION OF THE INVENTION

Figure 1:
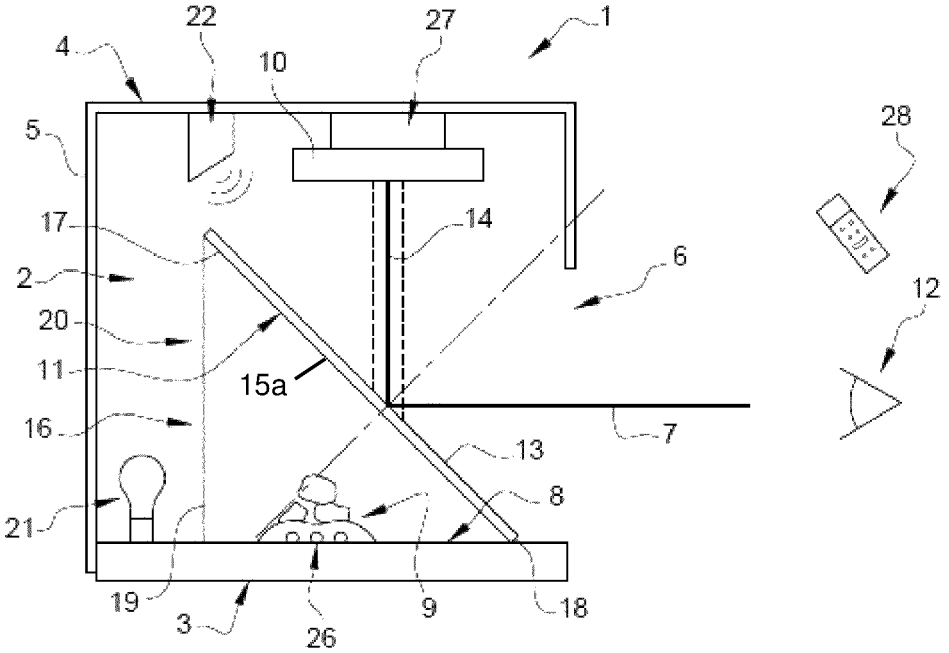
FIG. 1 is a schematic cross-sectional view of a fireplace according to the invention.

As visible in the accompanying drawings, the present invention relates to an artificial fireplace 1, for a fireplace unit, insert or stove, comprising an enclosure 2 delimited by a lower wall 3, an upper wall 4, and a peripheral wall 5.

Figure 2:
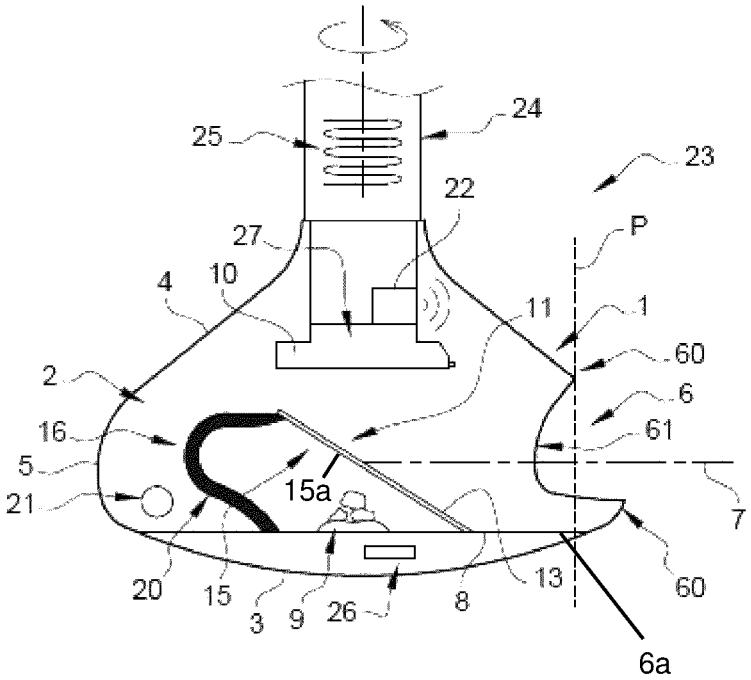
FIG. 2 is a schematic cross-sectional view of a fireplace unit comprising a fireplace according to the invention.

Of course, said fireplace 1 may assume various embodiments. In particular, the lower 3 and upper wall 4, just like the peripheral wall 5, can be more or less concave, so as to provide said fireplace 1 with a substantially spherical shape. As can be seen in FIG. 2, for example, the various walls 3, 4, 5 are a continuation of one another. In this embodiment, the lower wall 3 and the peripheral wall 5 provide the fireplace with an oblate shape, extended and topped by a cone formed by the upper wall 4.

In this context, the lower wall 3 of the fireplace 1 will be considered to be the wall closing said fireplace in the lower region thereof. Simultaneously, the upper wall 4 covers the enclosure 2 of the fireplace 1. Finally, the peripheral wall 5 corresponds to the casing which laterally surrounds said enclosure 2.

In this connection, said peripheral wall 5 comprises an opening 6 which offers a line of sight 7 of the inside of the enclosure 2 of the fireplace 1. In the embodiment of FIG. 2, the opening 6 corresponds to a mouth which is ovoid in shape and fits to the curvature of the peripheral wall 5. The central part 60 of the opening 6 extends in the region of a plane P or in front of said plane P. More precisely, the upper central part 60 extends in the region of the plane P. As far as the lower central part 60 is concerned, it extends, in this embodiment, in front of the plane P. This is shown in FIG. 2, the plane P being tangential to the curvature of the peripheral wall 5. In contrast, the lateral edges 61 of the opening 6 extend so as to be set back from the plane P. This specific design of the opening 6 contributes to reducing the parasitic reflections which originate from the outside of the enclosure 2.

More particularly, in said enclosure 2, the lower wall 3 of the fireplace 1 defines the base 8 of the enclosure. The artificial fireplace 1 comprises a bed of fake embers 9 on the base 8 of the enclosure. Moreover, the bed of fake embers 9 is arranged in the line of sight 7.

Furthermore, projection means 10 are arranged inside said enclosure 2. The projection means 10 are preferably designed to transmit a linear polarized light. By way of example, it is possible to use, for this purpose, a video screen of the LCD type. In all cases, according to the invention the projection means 10 are designed to transmit an image of animated flames towards a display screen 11.

As shown in FIGS. 1 and 2, the artificial fireplace 1 comprises a display screen 11 which is arranged in the enclosure 2. The display screen 11 is preferably arranged in the line of sight 7 of an observer 12 located in front of the opening 6 of the artificial fireplace 1.

Advantageously, said projection means 10 are installed under the upper wall 4 of the enclosure 2. The projection means 10 are furthermore defined so as to broadcast images, in particular of animated flames, through a linear polarized light. The design and the cooperation of the display screen 11 and the projection means 10 allow for the formation of a virtual image in the line of sight 7. In particular, said virtual image is formed, in the line of sight 7, at the rear of the display screen 11, in the region where the bed of fake embers 9 is arranged.

As regards the display screen 11, this is arranged in the enclosure 2, between the projection means 10 and the bed of fake embers 9, and in the extension 6*a* of the opening 6.

According to the invention, the display screen 11 is defined by viewing optics. In practice, the viewing optics is formed by a transparent plate 13. Said transparent plate 13 is preferably made of glass. Typically, the transparent plate 13 can be considered to be a diopter.

As shown in FIG. 5, the transparent plate 13 is designed such that the projection means 10 emit a linear polarized light according to Brewster's angle. A Fresnel reflection according to Brewster's angle is thus produced. For this purpose, the transparent plate 13 is arranged according to an angle iB of between 50° and 56° with respect to the incident ray emitted by the projection means 10. Said angular measurement corresponds to what is known as Brewster's angle.

Figure 3:
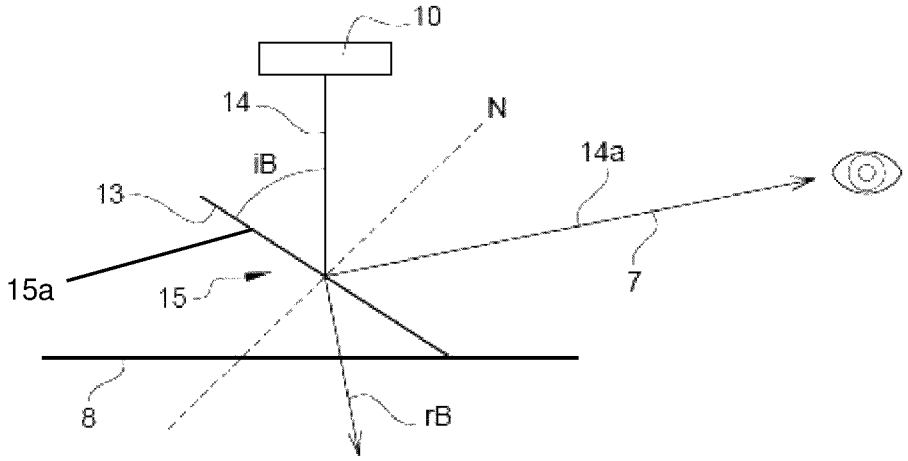
FIG. 3 schematically shows the reflection principle used for displaying a virtual image on a display screen.

Advantageously, the projection of a linear polarized light onto the transparent plate 13, according to Brewster's angle, contributes to causing the partial reflection, typically produced when a light beam is transmitted on a diopter, to disappear. This is due to the fact that the refracted ray rB is perpendicular to the reflected ray 14*a*. However, according to this direction of refraction, the refracted light beam does not appear in the line of sight 7 of an observer, and is therefore not visible to said observer (shown in FIG. 3). The clarity of the virtual image formed on the transparent plate 13 is thus optimized, thus increasing the impression of realism of the virtual image for an observer located in the line of sight 7.

The advantages of this design consist in that the transparent plate 13 reflects an image, towards the line of sight 7, which is made up of a single polarized component which is formed by the reflected ray 14*a*. The clarity of the virtual image formed in the line of sight 7 is furthermore optimized by the reduction of the reflections originating from the external environment.

For this purpose, the transparent plate 13 comprises, in the region of the rear face 15 thereof and visible through the opening 6 of the enclosure 2, an anti-reflective treatment 15*a*, so as to prevent any light, emanating from a source other than that corresponding to the projection means 10, from interfering with the holographic image thus produced.

Moreover, the three-dimensional geometric shape of the fireplace 2 and of the opening 6 shown in FIG. 2 also contributes to reducing the reflections of parasitic light originating from outside the fireplace 2.

The observer 12 in front of the opening 6, not perceiving the transparent plate 13, gains the illusion that flames are burning below the bed of fake embers 9.

To this end, the transparent glass plate 13 is designed to be adjusted to the walls 3, 4, 5 of the enclosure 2. For this purpose, the transparent plate 13 is dimensioned depending on the dimensions of the enclosure 2, and in particular a cross section of the enclosure 2. Moreover, the transparent plate 13 is advantageously of a shape similar to the geometric shape of a cross section of the enclosure 2. In the embodiment of FIG. 2, the cross section is in the geometric shape of an ovoid.

The fact that the transparent plate 13 is adjusted to the walls 3, 4, 5 of the enclosure 2 contributes to concealing the presence of the transparent plate 15 from the view of a user located in the line of sight 7.

The transparent plate 13 can be held in the enclosure 2, under the conditions cited above, by means of a support structure 16 which can be of various embodiments.

Thus, said support structure 16 may be in the form of a simple support rim (not shown) in the region of the peripheral wall 5, inside the enclosure 2, so as to achieve support on the upper rim 17 of the transparent plate 13, the lower rim 18 of which rests, for example, on the base 8.

As can be seen in FIG. 2, said support structure 16 may furthermore take the form of a bracket 19 which rests on said base 8, at the rear of the bed of fake embers 9. The upper rim 17 of the transparent plate 13 rests on said bracket, under the inclination conditions mentioned above. Furthermore, said bracket 19 may define a screen 20 behind the bed of fake embers 9.

Ambient lighting means 21 capable of diffusing ambient light in the fireplace 1 can also be installed in the enclosure 2. Said ambient lighting means 21 may for example be located at the rear of the screen 20 formed by the bracket 19, between said screen and the peripheral wall 5 of the enclosure 2.

The fireplace according to the invention may also be equipped with sound diffusion and/or odor emissions means 22. By way of example, these may be installed in the enclosure 2, under the upper wall 4, preferably outside of the field of view provided by the opening 6. Such sound diffusion and/or odor emissions means 22 can, for example, emit sounds which imitate the crackling of a wood fire and/or an odor of wood.

As mentioned above, a fireplace according to the invention may equip a fireplace unit or indeed a stove. It is well established that the fireplace of a fireplace unit or of a stove is traditionally connected to a flue.

In addition, a fireplace unit 23, as visible in FIG. 2, or a stove comprising a fireplace 1 according to the invention may be equipped with a fake flue 24, inside which heating means or heater 25 may be located. Said heating means are preferably of the dry inertia electric type.

Advantageously again, said fake flue 24 may substantially constitute suspension means of the fireplace 1.

According to another particularity of the invention, the fireplace 1 is mounted so as to be rotatable about a vertical axis through, depending on the case, these suspension means preferably defined by a fake flue 24, or a support base on which the fireplace 1 rests (solution not shown).

As regards the bed of embers 9, it may be made up of different elements imitating a combination of wood being burned, embers, and ashes (fire imitation elements). Advantageously, the materials are selected so as to allow light radiation, produced by the fire imitation lighting means 26 which are preferably installed under said bed of embers 9, to show through, in part. Said fire imitation lighting means 26, advantageously in the form of LEDs, may be subjected to a variation of light intensity in order to simulate the animation of real incandescent embers.

According to another particularity of the invention, the fireplace 1 comprises means 27 for controlling and managing the operation:

Of the projection means 10;

And/or of the ambient lighting means 21;

And/or of the sound diffusion and/or odor emissions means 22;

And/or of the fire imitation lighting means 26 under the bed of embers 9;

And/or of the heating means or heater 25.

Remote control means 28, operating by radio frequency, Wi-Fi, Bluetooth, or the like, which are capable of offering the user a plurality of selections of the mode of operation of the fireplace 1, may be associated with control and management means 27 of this kind.

Thus, using such control and management means 27 and/or remote control means 28, a user can, for example, select a video sequence from a plurality of such sequences which can be projected by the projection means 10, and/or select different modes of ambient lighting, and/or select a particular sound diffusion band and/or a particular odor emission from a proposed range.

The fire imitation lighting means 26 under the bed of embers 9 can, in turn, adopt different light variation cycles of the LEDs of which they are made up, which cycles can be selected by such remote control means 28 and/or directly by the control and management means 27.

Of course, these same means 27, 28 are capable of offering the user the possibility of intervening in the mode of operation of the heating means 25.

Finally, the combination of means which the fireplace 1 according to the invention comprises offers the user the possibility of artificially reproducing a wood fire in different combustion states, for example that of an animated high-heat fire having strong flames, in order to create a welcoming and warm atmosphere, or indeed that of a smoldering fire in order to create an impression of peace and well-being.

However, this artificial reproduction of a wood fire is achieved with a greater impression of realism which results from the use of a completely transparent screen which is virtually invisible to an observer located in front of the fireplace.

We claim:

1. An artificial fireplace, comprising:

an enclosure having a lower wall, an upper wall, and a peripheral wall so as to form an opening, said lower wall having a base;

a bed of fake embers being arranged inside said enclosure on said base of said lower wall;

a display screen being arranged in said enclosure so as to extend a line of sight from the display screen through said opening; and projection means being arranged in said enclosure so as to transmit an image of animated flames towards said display screen as an incident ray, wherein said display screen is comprised of a transparent glass plate extending between said bed of fake embers and said projection means at an angle of between 50 degrees and 56 degrees so as to transmit said image through linear polarized light according to an incident ray and said line of sight.

2. The artificial fireplace, according to claim 1, wherein said projection means are installed under said upper wall of said enclosure.

3. The artificial fireplace, according to claim 1, wherein said base is comprised of an extension so as to extend said opening at a specified angle to said base, said display screen extending between said projection means and said bed of fake embers in said enclosure according to said extension.

4. The artificial fireplace, according to claim 1, wherein said transparent glass plate has a rear face, and wherein said transparent glass plate is comprised of an anti-reflective treatment on said rear face.

5. The artificial fireplace, according to claim 1, wherein said display screen is further comprised of a support structure so as to hold said transparent glass plate in said enclosure, and wherein said support structure is comprised of a bracket rested on said base between said peripheral wall and said bed of fake embers.

6. The artificial fireplace, according to claim 1, wherein said transparent glass plate is adjustable between said lower wall, said upper wall, and said peripheral wall of said enclosure.

7. The artificial fireplace, according to claim 1, further comprising: sound diffusion and/or odor emissions means.

8. The artificial fireplace, according to claim 1, further comprising: ambient lighting means within said enclosure so as to diffuse an ambient light in the enclosure.

9. The artificial fireplace, according to claim 1, further comprising:

fire imitation lighting means being installed under said bed of embers and being comprised of light emitting diodes, wherein said bed of embers-is comprised of fire imitation elements, and wherein said fire imitation elements are comprised of materials so as to simulate animation of incandescent embers by passing light radiation through said fire imitation elements.

10. The artificial fireplace, according to claim 1, further comprising:

ambient lighting means within said enclosure so as to diffuse an ambient light in the enclosure;

sound diffusion and/or odor emissions means;

a heater connected to said enclosure;

fire imitation lighting means being installed under said bed of embers; and means for controlling and managing operation of at least one of a group consisting of, the projection means, the ambient lighting means, the sound diffusion and/or odor emissions means, the fire imitation lighting means under said bed of embers, and said heater.

11. The artificial fireplace, according to claim 1, further comprising:

a fake flue having a vertical axis and being rotatably mounted to said enclosure so as to suspend said enclosure from said fake flue.

12. A unit, comprising:

the artificial fireplace, according to claim 11; and a heater integrated in said fake flue.

* * * * *